US007766025B2

(12) United States Patent
Greco

(10) Patent No.: US 7,766,025 B2
(45) Date of Patent: Aug. 3, 2010

(54) PERIODIC REGENERATIVE HEAT EXCHANGER

(76) Inventor: Richard Greco, 2688 SW. Glenmoor Way, Palm City, FL (US) 34990

( * ) Notice: Subject to any disclaimer, the term of this patent is extended or adjusted under 35 U.S.C. 154(b) by 623 days.

(21) Appl. No.: 11/766,214

(22) Filed: Jun. 21, 2007

(65) Prior Publication Data

US 2008/0314550 A1 Dec. 25, 2008

(51) Int. Cl.
*F28D 17/00* (2006.01)

(52) U.S. Cl. ..... 137/1; 137/309; 137/340; 137/597; 165/4

(58) Field of Classification Search ..... 137/1, 137/309, 340, 597; 165/4
See application file for complete search history.

(56) References Cited

U.S. PATENT DOCUMENTS 1,543,909 A * 6/1925 Dyrssen ..... 137/309
1,835,148 A * 12/1931 Dyrssen ..... 165/4
3,770,050 A * 11/1973 Nakanishi ..... 137/309
5,129,332 A 7/1992 Greco
5,163,466 A * 11/1992 Moody ..... 137/597
5,983,986 A 11/1999 Macintyre et al.
6,039,927 A 3/2000 Greco
7,082,987 B2 8/2006 Hamilton
2005/0126746 A1 6/2005 D'Souza

* cited by examiner

*Primary Examiner*—Kevin L Lee
(74) *Attorney, Agent, or Firm*—Robert L. Kelly; Dickinson Wright PLLC

(57) ABSTRACT

A regenerative heat exchanger includes a pair of heat exchangers, an inlet valve assembly and an outlet valve assembly. Each valve assembly includes two corresponding pairs of valve ports and two poppet discs each being movable between said corresponding pairs of valve ports. The poppet discs have rods extending to distal ends. Distal ends extending from the inlet valve assembly are pivotably interconnected to distal ends from the outlet valve assembly and pivotably interconnected to a crank of an eccentric mechanical drive to operate one of the inlet poppet discs and one of the outlet poppet discs in tandem.

20 Claims, 3 Drawing Sheets

PERIODIC REGENERATIVE HEAT EXCHANGER

BACKGROUND OF THE INVENTION

1. Field of the Invention

The subject invention relates generally to a regenerative heat exchanger assembly.

2. Description of the Prior Art

Known regenerative heat exchanger assemblies used to transfer heat energy from a dirty airstream to a clean airstream. One example of a known regenerative heat exchanger assemblies includes a heat wheel divided into pie shaped segments. The heat wheel rotates and alternately passes over hot dirty gases, and cold clean gases. To prevent cross contamination, sliding seals are used.

SUMMARY OF THE INVENTION AND ADVANTAGES

The invention provides for such a regenerative heat exchanger assembly including a first heat exchanger having a plurality of first heat recovery media, and a second heat exchanger having a plurality of second heat recovery media. An inlet valve assembly and an outlet valve assembly are in fluid communication with the first and second heat exchangers. The inlet valve assembly has two corresponding pairs of inlet valve ports, and two inlet poppet discs each being movable between one of the corresponding pairs of inlet valve ports. The outlet valve assembly has two corresponding pairs of outlet valve ports, and two outlet poppet discs each being movable between one of the corresponding pairs of outlet valve ports. A first inlet rod extends from one of the inlet poppet discs to a first inlet distal end, and a first outlet rod extends from one of the outlet poppet discs to a first outlet distal end. An eccentric mechanical drive includes a first crank for rotation about an axis and a first linkage assembly connected to the first crank for orbital movement about the axis. The first linkage assembly interconnects the first inlet distal end to the first outlet distal end to operate one of the inlet poppet discs and one of the outlet poppet discs in tandem.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
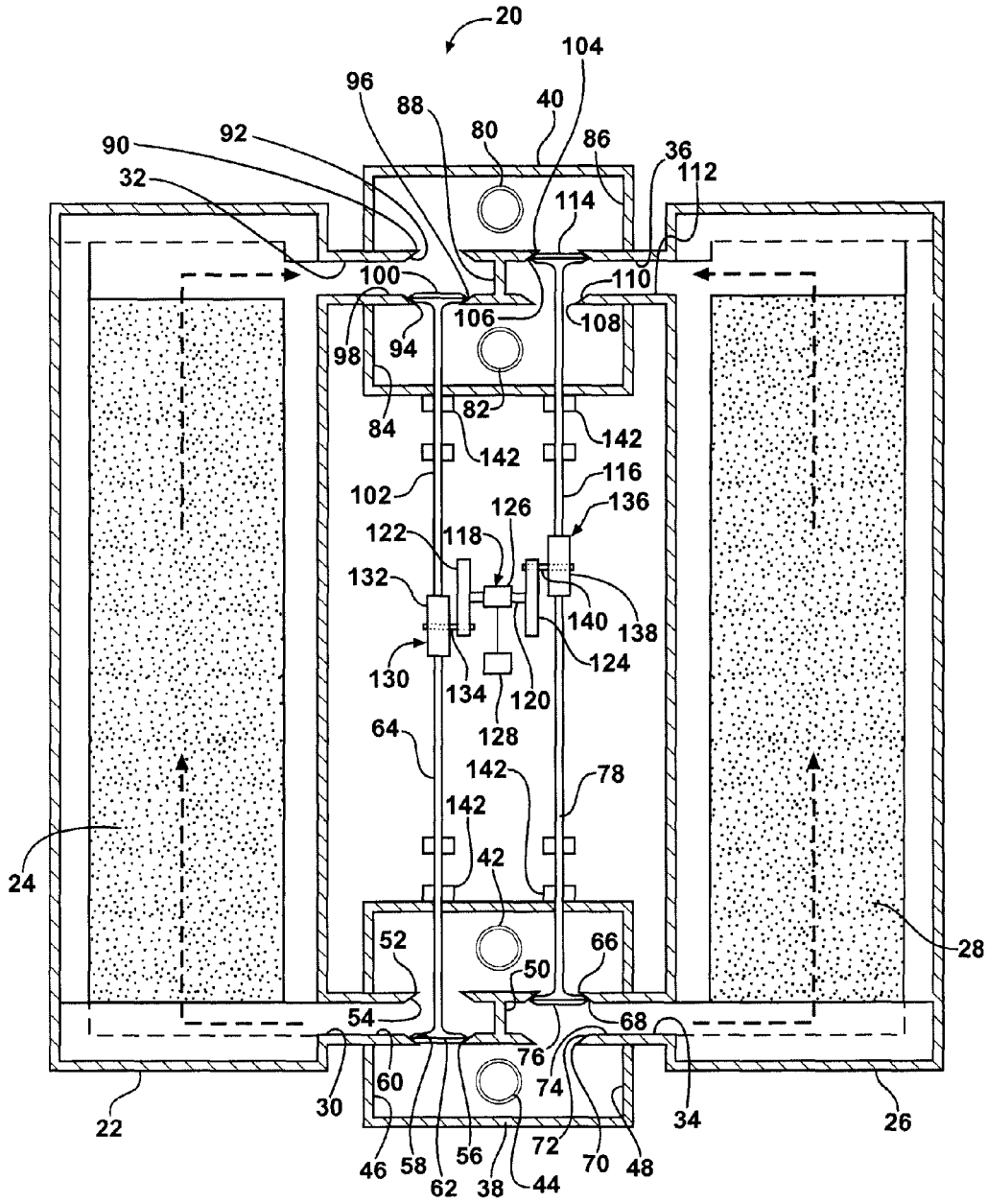
FIG. 1 is a schematic view of a periodic regenerative heat exchanger in accordance with an exemplary embodiment of the present invention.
Figure 2:
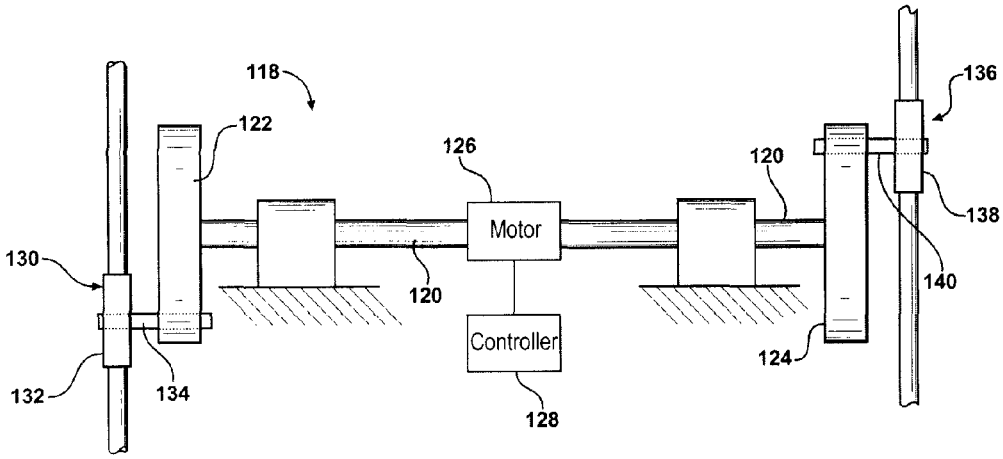
FIG. 2 is a front view of an eccentric mechanical drive in isolation.

Referring to the Figures, wherein like numerals indicate corresponding parts throughout the several views, a regenerative heat exchanger assembly is generally shown at 20. The regenerative heat exchanger assembly 20 includes a first heat exchanger 22 having a plurality of first heat recovery media 24, and a second heat exchanger 26 having a plurality of second heat recovery media 28. The first and second heat recovery media 24, 28 could include any suitable material for receiving and transferring heat from one gas stream to another, including, for example, stacked wire mesh, porous ceramic monolith, or a random packed ceramic saddle. The first heat exchanger 22 has a first inlet port 30 and a first outlet port 32, and the second heat exchanger 26 has a second inlet port 34 and a second outlet port 36. An inlet valve assembly 38 and an outlet valve assembly 40 in fluid communication with the first and second heat exchangers 22, 26 are also provided.

The inlet valve assembly 38 includes a dirty gas inlet 42 and a clean gas inlet 44. The dirty gas inlet 42 receives a heated gas stream, such as dirty flue gases in a power plant. The clean gas inlet 44 receives a cool gas stream, such as clean ambient air for use in combustion. Using the regenerative heat exchanger assembly 20 to raise the temperature of the clean ambient air minimizes the amount of virgin fuel needed for combustion. The inlet valve assembly 38 has a left inlet valve area 46 and a right inlet valve area 48 fluidly isolated from one another by an inlet dividing wall 50.

An upper left inlet valve port 52 is disposed in the left inlet valve area 46. An upper left inlet valve seat 54 is disposed around the upper left inlet valve port 52. A lower left inlet valve port 56 is disposed in the left inlet valve area 46 and is aligned with the upper left inlet valve port 52. A lower left inlet valve seat 58 is disposed around the lower left inlet valve port 56. A left discharge port 60 is disposed adjacent to the left inlet valve area 46 and is in fluid communication with the first inlet port 30 of the first heat exchanger 22. An inlet left poppet disc 62 is disposed in the left inlet valve area 46. The inlet left poppet disc 62 is movable between the upper left and lower left inlet valve ports 52, 56. A first inlet rod 64 extends from the inlet left poppet disc 62 to a first inlet distal end.

An upper right inlet valve port 66 is disposed in the right inlet valve area 48, and an upper right inlet valve seat 68 is disposed around the upper right inlet valve port 66. A lower right inlet valve port 70 is disposed in the right inlet valve area 48 and is aligned with the upper right inlet valve port 66. A lower right inlet valve seat 72 is disposed around the lower right inlet valve port 70. A right discharge port 74 is disposed adjacent to the right inlet valve area 48 and is in fluid communication with the second inlet port 34 of the second heat exchanger 26. An inlet right poppet disc 76 is disposed in the right inlet valve area 48 and is movable between the upper right and lower right inlet valve ports 66, 70. A second inlet rod 78 extends from the inlet right poppet disc 76 to a second inlet distal end.

The outlet valve assembly 40 includes a dirty gas outlet 80 and a clean gas outlet 82. The dirty gas outlet 80 discharges the, then cooled, dirty flue gases from the regenerative heat exchanger assembly 20. The clean gas outlet 82 directs the, then heated, clean air as needed for combustion. The outlet valve assembly 40 has a left outlet valve area 84 and a right outlet valve area 86 fluidly isolated from one another by an outlet dividing wall 88.

An upper left outlet valve port 90 is disposed in the left outlet valve area 84, and includes an upper left outlet valve seat 92 disposed around the upper left outlet valve port 90. A lower left outlet valve port 94 is disposed in the left outlet valve area 84 and is aligned with the upper left outlet valve port 90. A lower left outlet valve seat 96 is disposed around the lower left outlet valve port 94. A left receiving port 98 is disposed adjacent to the left outlet valve area 84 and is in fluid communication with the first outlet port 32 of the first heat exchanger 22. An outlet left poppet disc 100 is disposed in the left outlet valve area 84 and is movable between the upper left and lower left outlet valve ports 90, 94. A first outlet rod 102 extends from the outlet left poppet disc 100 to a first outlet distal end.

An upper right outlet valve port 104 is disposed in the right outlet valve area 86 and includes an upper right outlet valve seat 106 disposed around the upper right outlet valve port 104. A lower right outlet valve port 108 is disposed in the right outlet valve area 86 and is aligned with the upper right outlet valve port 104. A lower right outlet valve seat 110 is disposed around the lower right outlet valve port 108. A right receiving port 112 is disposed adjacent to the right outlet valve area 86 and is in fluid communication with the second outlet port 36 of the second heat exchanger 26. An outlet right poppet disc 114 is disposed in the right outlet valve area 86 and is movable between the upper right and lower right outlet valve ports 104, 108. A second outlet rod 116 extends from the outlet right poppet disc 114 to a second outlet distal end.

An eccentric mechanical drive is generally shown at 118. The eccentric mechanical drive 118 includes a drive shaft 120 extending along an axis between a left end and a right end. The drive shaft 120 supports a first crank 122 at the left end, and a second crank 124, 180 degrees out of phase with the first crank 122, is supported at the right end. A motor 126 is provided for rotating the drive shaft 120, and a controller 128 communicates with the motor 126 to selectively energize the motor 126. The details of the motor 126 and controller 128 operation are discussed in more detail below.

A first linkage assembly, generally shown at 130, is connected to the first crank 122 for orbital movement about the axis. The first linkage assembly 130 interconnects the first inlet distal end of the first inlet rod 64 to the first outlet distal end of the first outlet rod 102. This allows to operate the inlet left poppet disc 62 in tandem with the outlet left poppet disc 100 by turning the first crank 122. Thus, when the inlet left poppet disc 62 is sealed against the upper left inlet valve seat 54, the outlet left poppet disc 100 is sealed against the upper left outlet valve seat 92. The first linkage assembly 130 includes a first connector 132 pivotably interconnecting the first inlet distal end to the first outlet distal end, and a first pin 134 pivotably interconnecting the first connector 132 to the first crank 122.

Likewise, a second linkage assembly, generally shown at 136, is connected to the second crank 124. The second linkage assembly 136 interconnects the second inlet distal end to the second outlet distal end to operate the inlet right poppet disc 76 in tandem with the outlet right poppet disc 114. The second linkage assembly 136 includes a second connector 138 pivotably interconnecting the second inlet distal end to the second outlet distal end, and a second pin 140 pivotably interconnecting the second connector 138 to the second crank 124.

A plurality of bushings 142 are provided to guide the first and second inlet rods 64, 78 and the first and second outlet rods 102, 116. The bushings 142 are attached to the inlet and outlet valve assemblies 38, 40 and surround the rods 64, 78, 102, 116 to provide support for movement along a linear path as the rods 64, 78, 102, 116 translate in response to the eccentric mechanical drive 118.

The controller 128 is a variable speed drive that can operate the motor 126 to complete a degree cycle in less than 0.5 seconds. The variable speed drive accelerates the motor 126 for 0.2 seconds, and the decelerates the motor 126 for 0.3 seconds. This timing prevents the poppet discs 62, 76, 100, 114 from contacting their respective valve seats 54, 58, 68, 72, 92, 96, 106, 110 with excessive force. As noted earlier, the second crank 124 is out of phase by 180 degrees with the first crank 122. Thus, when the inlet left poppet disc 62 and the outlet left poppet disc 100 are sealed against the upper left inlet and upper left outlet valve seats 54, 92, the inlet right poppet disc 76 and outlet right poppet disc 114 are sealed against the lower right inlet and lower right outlet valve seats 72, 110. In addition, rotation of the drive shaft 120 has a first rotational position and a second rotational position spaced radially about the drive shaft 120 from the first rotational position by 180 degrees.

Figure 3:
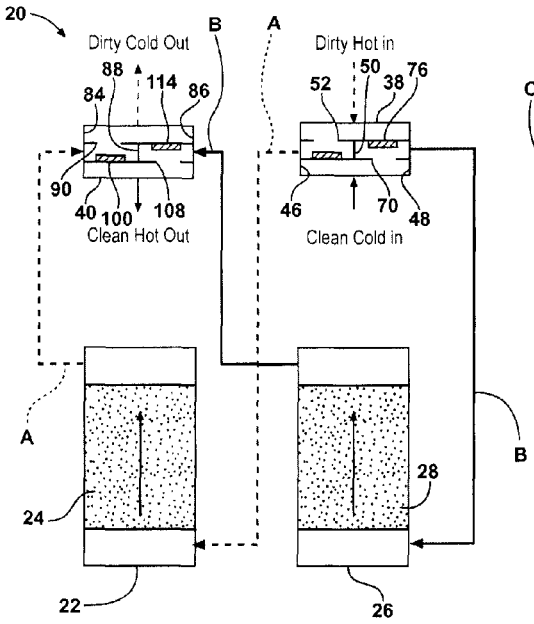
FIG. 3 is a schematic view of the periodic regenerative heat exchanger showing a first and a second flow path.

Referring next to FIG. 3, when the drive shaft 120 is moved to the first rotational position, the inlet left poppet disc 62 seals against the lower left inlet valve seat 58, and a first flow path A is thereby defined to move dirty hot gas from the dirty gas inlet 42, through the upper left inlet valve port 52 and through the left discharge port 60 and into the first heat exchanger 22. In FIG. 3, the first flow path A is identified by the dashed line representing the flow of dirty gas. As the dirty hot gas moves through the first heat exchanger 22, its heat is transferred to the first heat recovery media 24, which produces dirty cold gas. With the drive shaft 120 still in the first rotational position, the outlet left poppet disc 100 is sealed against the lower left outlet valve seat 96, thereby further defining the first flow path A to move the dirty cold gas out of the first heat exchanger 22 and through the left receiving port 98 and through the upper left outlet valve port 90 and out through the dirty gas outlet 80.

Simultaneously, with the drive shaft 120 still in the first rotational position, the inlet right poppet disc 76 is sealed against the upper right inlet valve seat 68, thereby defining a second flow path B to move clean cold gas from the clean gas inlet 44, through the lower right inlet valve port 70 and through the right discharge port 74, into the second heat exchanger 26. In FIG. 3, the second flow path B is identified by the solid line representing the flow of clean gas. As the clean cold gas moves through the second heat exchanger 26, heat stored in the second heat recovery media 28 is transferred to the clean cold gas to produce clean hot gas. With the drive shaft 120 still in the first rotational position, the outlet right poppet disc 114 is sealed against the upper right outlet valve seat 106. The second flow path B is further defined to move the clean hot gas out of the second heat exchanger 26 and through the right receiving port 112, through the lower right outlet valve port 108 and out through the clean gas outlet 82.

Figure 4:
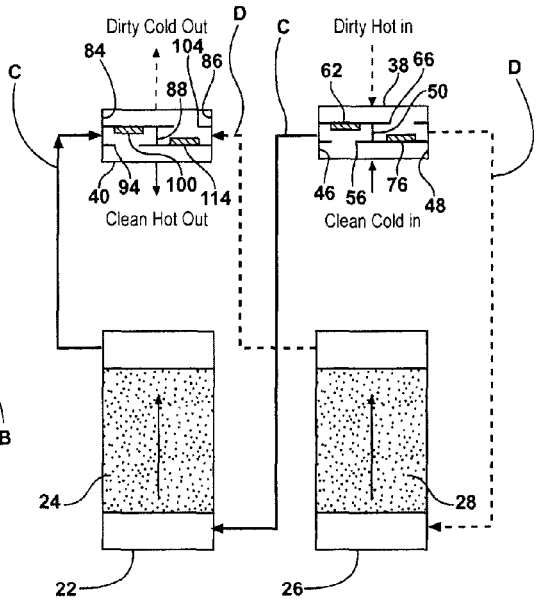
FIG. 4 is a schematic view of the periodic regenerative heat exchanger showing a third and a fourth flow path.

Referring next to FIG. 4, the drive shaft 120 is rotated to the second rotational position, where the inlet left poppet disc 62 is now sealed against the upper left inlet valve seat 54. This position defines to a third flow path C to move clean cold gas from the clean gas inlet 44 through the lower left inlet valve port 56, through the left discharge port 60 and into the first heat exchanger 22. In FIG. 4, the third flow path C is identified by the solid line representing the flow of clean gas. As the clean cold gas moves through the first heat exchanger 22, heat that was absorbed by the first heat recovery media 24 in the previous half of the cycle is transferred to the clean cold gas to produce clean hot gas. In addition, the first heat recovery media 24 is now ready to receive additional heat. With the drive shaft 120 still in the second rotational position, the outlet left poppet disc 100 is sealed against the upper left outlet valve seat 92. This further defines the third flow path C to move the clean hot gas from the first heat exchanger 22, through the right receiving port 112, through the lower left outlet valve port 94 and out through the clean gas outlet 82.

Simultaneously, while the drive shaft 120 is still in the second rotational position, the inlet right poppet disc 76 is sealed against the lower right inlet valve seat 72 to define a fourth flow path D to move dirty hot gas from the dirty gas inlet 42, through the upper right inlet valve port 66, through the right discharge port 74 and into the second heat exchanger 26. In FIG. 4, the fourth flow path D is identified by the dashed line representing the flow of dirty gas. As the dirty hot gas moves through the second heat exchanger 26, it transfers its heat to the second heat recovery media 28 that was previously cooled in the previous half of the cycle, to produce dirty cold gas. With the drive shaft 120 still in the second rotational position, the outlet right poppet disc 114 is sealed against the lower right outlet valve seat 110. The fourth flow path D is further defined to move the dirty cold gas out of the second heat exchanger 26, through the right receiving port 112, through the upper right outlet valve port 104 and out through the dirty gas outlet 80.

This cycle then repeats, with the first and second heat recovery media 24, 28 being alternatively heated and cooled by the two gas streams, moving the heat from the dirty gas to the clean gas. Such systems can attain thermal efficiencies as high as 95%.

Obviously, many modifications and variations of the present invention are possible in light of the above teachings and may be practiced otherwise than as specifically described while within the scope of the appended claims.

What is claimed is:

1. A regenerative heat exchanger assembly comprising;

a first heat exchanger including a plurality of first heat recovery media for transferring heat, a second heat exchanger including a plurality of second heat recovery media for transferring heat, an inlet valve assembly in fluid communication with said first and second heat exchangers, an outlet valve assembly in fluid communication with said first and second heat exchangers, said inlet valve assembly having two corresponding pairs of inlet valve ports, said inlet valve assembly including two inlet poppet discs each being movable between one of said corresponding pairs of inlet valve ports for defining multiple flow passages therethrough, said outlet valve assembly having two corresponding pairs of outlet valve ports, said outlet valve assembly including two outlet poppet discs each being movable between one of said corresponding pairs of outlet valve ports for defining multiple flow passages therethrough, a first inlet rod extending from one of said inlet poppet discs to a first inlet distal end, a first outlet rod extending from one of said outlet poppet discs to a first outlet distal end, an eccentric mechanical drive including a first crank for rotation about an axis, a first linkage assembly connected to said first crank for orbital movement about said axis, and said first linkage assembly interconnecting said first inlet distal end to said first outlet distal end to operate one of said inlet poppet discs and one of said outlet poppet discs in tandem.

2. A regenerative heat exchanger assembly as set forth in claim 1 wherein one of said corresponding pairs of inlet valve ports includes an upper left inlet valve port and a lower left inlet valve port aligned with said upper left inlet valve port and wherein said inlet poppet discs include an inlet left poppet disc disposed between said upper left and lower left inlet valve ports.

3. A regenerative heat exchanger assembly as set forth in claim 2 wherein one of said corresponding pairs of outlet valve ports includes an upper left outlet valve port and a lower left outlet valve port aligned with said upper left outlet valve port and wherein said outlet poppet discs include an outlet left poppet disc disposed between said upper left and lower left outlet valve ports.

4. A regenerative heat exchanger assembly as set forth in claim 3 wherein said first inlet rod extends from said inlet left poppet disc and wherein said first outlet rod extends from said outlet left poppet disc.

5. A regenerative heat exchanger assembly as set forth in claim 4 wherein said first linkage assembly includes a first connector pivotably interconnecting said first inlet distal end to said first outlet distal end and a first pin pivotably interconnecting said first connector to said first crank.

6. A regenerative heat exchanger assembly as set forth in claim 4 wherein one of said corresponding pairs of inlet valve ports includes an upper right inlet valve port and a lower right inlet valve port aligned with said upper right inlet valve port and wherein one of said corresponding pairs of outlet valve ports includes an upper right outlet valve port and a lower right outlet valve port aligned with said upper right outlet valve port.

7. A regenerative heat exchanger assembly as set forth in claim 6 wherein said inlet poppet discs include an inlet right poppet disc disposed between said upper right and lower right inlet valve ports and wherein said outlet poppet discs include an outlet right poppet disc disposed between said upper right and lower right outlet valve ports.

8. A regenerative heat exchanger assembly as set forth in claim 7 including a second inlet rod extending from said inlet right poppet disc to a second inlet distal end and including a second outlet rod extending from said outlet right poppet disc to a second outlet distal end.

9. A regenerative heat exchanger assembly as set forth in claim 8 including;

said eccentric mechanical drive having a second crank, a second linkage assembly connected to said second crank, and said second linkage assembly interconnecting said second inlet distal end to said second outlet distal end.

10. A regenerative heat exchanger assembly as set forth in claim 9 wherein said second linkage assembly includes a second connector pivotably interconnecting said second inlet distal end to said second outlet distal end and a second pin pivotably interconnecting said second connector to said second crank.

11. A regenerative heat exchanger assembly as set forth in claim 9 wherein said second crank is 180 degrees out of phase with said first crank.

12. A regenerative heat exchanger assembly as set forth in claim 9 including;

said first heat exchanger having a first inlet port and a first outlet port, said second heat exchanger having a second inlet port and a second outlet port, said inlet valve assembly including a dirty gas inlet and a clean gas inlet, said inlet valve assembly having a left inlet valve area and a right inlet valve area, said inlet valve assembly including an inlet dividing wall fluidly isolating said left inlet valve area from said right inlet valve area, said inlet valve assembly including a left discharge port disposed adjacent to said left inlet valve area and in fluid communication with said first inlet port of said first heat exchanger, said inlet valve assembly including a right discharge port disposed adjacent to said right inlet valve area and in fluid communication with said second inlet port of said second heat exchanger, said upper left inlet valve port and said lower left inlet valve port being disposed in said left inlet valve area, said upper right inlet valve port and said lower right inlet valve port being disposed in said right inlet valve area, said outlet valve assembly including a dirty gas outlet and a clean gas outlet, said outlet valve assembly having a left outlet valve area and a right outlet valve area, said outlet valve assembly including an outlet dividing wall fluidly isolating said left outlet valve area from said right outlet valve area, said outlet valve assembly including a left receiving port disposed adjacent to said left outlet valve area and in fluid communication with said first outlet port of said first heat exchanger, said outlet valve assembly including a right receiving port disposed adjacent to said right outlet valve area and in fluid communication with said second outlet port of said second heat exchanger, said upper left outlet valve port and said lower left outlet valve port being disposed in said left outlet valve area, and said upper right outlet valve port and said lower right outlet valve port being disposed in said right outlet valve area.

13. A regenerative heat exchanger assembly as set forth in claim 12 wherein said eccentric mechanical drive includes a drive shaft extending between a left end and a right end and wherein said first crank is disposed at said first end and said second crank is disposed at said second end and wherein said drive shaft defines a first rotational position and a second rotational position spaced radially about said drive shaft by 180 degrees from said first rotational position.

14. A regenerative heat exchanger assembly as set forth in claim 13 including;

said inlet valve assembly including a lower left inlet valve seat disposed around said lower left inlet valve port and an upper right inlet valve seat disposed around said upper right inlet valve port, said outlet valve assembly including a lower left outlet valve seat disposed around said lower left outlet valve port and an upper right outlet valve seat disposed around said upper right outlet valve port, said inlet left poppet disc sealing against said lower left inlet valve seat when said drive shaft is moved to said first rotational position to define a first flow path for moving dirty hot gas from said dirty gas inlet and through said upper left inlet valve port and through said left discharge port and into said first heat exchanger for transferring heat from the dirty hot gas to said first heat recovery media to produce dirty cold gas, said outlet left poppet disc sealing against said lower left outlet valve seat when said drive shaft is moved to said first rotational position to further define the first flow path for moving the dirty cold gas from said first heat exchanger and through said left receiving port and through said upper left outlet valve port and out through said dirty gas outlet, said inlet right poppet disc sealing against said upper right inlet valve seat when said drive shaft is moved to said first rotational position to define a second flow path for moving clean cold gas from said clean gas inlet and through said lower right inlet valve port and through said right discharge port and into said second heat exchanger for transferring heat from said second heat recovery media to the clean cold gas to produce clean hot gas, and said outlet right poppet disc sealing against said upper right outlet valve seat when said drive shaft is moved to said first rotational position to further define the second flow path for moving the clean hot gas from said second heat exchanger and through said right receiving port and through said lower right outlet valve port and out through said clean gas outlet.

15. A regenerative heat exchanger assembly as set forth in claim 13 including;

said inlet valve assembly including an upper left inlet valve seat disposed around said upper left inlet valve port and a lower right inlet valve seat disposed around said lower right inlet valve port, said outlet valve assembly including an upper left outlet valve seat disposed around said upper left outlet valve port and a lower right outlet valve seat disposed around said lower right outlet valve port, said inlet left poppet disc sealing against said upper left inlet valve seat when said drive shaft is moved to said second rotational position to define a third flow path for moving clean cold gas from said clean gas inlet through said lower left inlet valve port and through said left discharge port and into said first heat exchanger for transferring heat from said first heat recovery media to said clean cold gas to produce clean hot gas, said outlet left poppet disc sealing against said upper left outlet valve seat when said drive shaft is moved to said second rotational position to further define the third flow path for moving the clean hot gas from said first heat exchanger and through said right receiving port and through said lower left outlet valve port and out through said clean gas outlet, said inlet right poppet disc sealing against said lower right inlet valve seat when said drive shaft is moved to said second rotational position to define a fourth flow path for moving dirty hot gas from said dirty gas inlet and through said upper right inlet valve port and through said right discharge port and into said second heat exchanger for transferring heat from the dirty hot gas to said second heat recovery media to produce dirty cold gas, and said outlet right poppet disc sealing against said lower right outlet valve seat when said drive shaft is moved to said second rotational position to further define the fourth flow path for moving the dirty cold gas from said second heat exchanger and through said right receiving port and through said upper right outlet valve port and out through said dirty gas outlet.

16. A regenerative heat exchanger assembly as set forth in claim 13 wherein said eccentric mechanical drive includes a motor for rotating said drive shaft and a controller for selectively energizing said motor.

17. A regenerative heat exchanger assembly comprising;

a first heat exchanger including a plurality of first heat recovery media for transferring heat, a second heat exchanger including a plurality of second heat recovery media for transferring heat, said first heat exchanger having a first inlet port and a first outlet port, said second heat exchanger having a second inlet port and a second outlet port, an inlet valve assembly in fluid communication with said first and second heat exchangers, an outlet valve assembly in fluid communication with said first and second heat exchangers, said inlet valve assembly including a dirty gas inlet, said inlet valve assembly including a clean gas inlet, said inlet valve assembly having a left inlet valve area and a right inlet valve area, said inlet valve assembly including an inlet dividing wall fluidly isolating said left inlet valve area from said right inlet valve area, said inlet valve assembly having an upper left inlet valve port disposed in said left inlet valve area, said inlet valve assembly including an upper left inlet valve seat disposed around said upper left inlet valve port, said inlet valve assembly having a lower left inlet valve port disposed in said left inlet valve area and aligned with said upper left inlet valve port, said inlet valve assembly including a lower left inlet valve seat disposed around said lower left inlet valve port, said inlet valve assembly including a left discharge port disposed adjacent to said left inlet valve area, said inlet valve assembly having an upper right inlet valve port disposed in said right inlet valve area, said inlet valve assembly including an upper right inlet valve seat disposed around said upper right inlet valve port, said inlet valve assembly having a lower right inlet valve port disposed in said right inlet valve area and aligned with said upper right inlet valve port, said inlet valve assembly including a lower right inlet valve seat disposed round said lower right inlet valve port, said inlet valve assembly including a right discharge port disposed adjacent to said right inlet valve area, said inlet valve assembly including an inlet left poppet disc disposed in said left inlet valve area and being movable between said upper left and lower left inlet valve ports, said inlet valve assembly including an inlet right poppet disc disposed in said right inlet valve area and being movable between said upper right and lower right inlet valve ports, said outlet valve assembly including a dirty gas outlet, said outlet valve assembly including a clean gas outlet, said outlet valve assembly having a left outlet valve area and a right outlet valve area, said outlet valve assembly including an outlet dividing wall fluidly isolating said left outlet valve area from said right outlet valve area, said outlet valve assembly having an upper left outlet valve port disposed in said left outlet valve area, said outlet valve assembly including an upper left outlet valve seat disposed round said upper left outlet valve port, said outlet valve assembly having a lower left outlet valve port disposed in said left outlet valve area and aligned with said upper left outlet valve port, said outlet valve assembly including a lower left outlet valve seat disposed around said lower left outlet valve port, said outlet valve assembly including a left receiving port disposed adjacent to said left outlet valve area, said outlet valve assembly having an upper right outlet valve port disposed in said right outlet valve area, said outlet valve assembly including an upper right outlet valve seat disposed around said upper right outlet valve port, said outlet valve assembly having a lower right outlet valve port disposed in said right outlet valve area and aligned with said upper right outlet valve port, said outlet valve assembly including a lower right outlet valve seat disposed around said lower right outlet valve port, said outlet valve assembly including a right receiving port disposed adjacent to said right outlet valve area, said outlet valve assembly including an outlet left poppet disc disposed in said left outlet valve area and being movable between said upper left and lower left outlet valve ports, said outlet valve assembly including an outlet right poppet disc disposed in said right outlet valve area and being movable between upper right and lower right outlet valve ports, a first inlet rod extending from said inlet left poppet disc to a first inlet distal end, a second inlet rod extending from said inlet right poppet disc to a second inlet distal end, a first outlet rod extending from said outlet left poppet disc to a first outlet distal end, a second outlet rod extending from said outlet right poppet disc to a second outlet distal end, a plurality of bushings surrounding said first and second inlet rods and said first and second outlet rods for movably supporting said first and second inlet rods and said first and second outlet rods along a linear path, an eccentric mechanical drive, said eccentric mechanical drive including a drive shaft extending along an axis between a left end and a right end, said eccentric mechanical drive including a motor for rotating said drive shaft, said eccentric mechanical drive including a first crank at said left end of said drive shaft for rotation about said axis, said eccentric mechanical drive including a second crank at said right end of said drive shaft for rotation about said axis, said second crank being 180 degrees out of phase with said first crank, said eccentric mechanical drive including a controller in communication with said motor for selectively energizing said motor to rotate said drive shaft, a first linkage assembly connected to said first crank for orbital movement about said axis, a second linkage assembly connected to said second crank for orbital movement about said axis, said first linkage assembly interconnecting said first inlet distal end to said first outlet distal end to operate said inlet left poppet disc in tandem with said outlet left poppet disc, said first linkage assembly including a first connector pivotably interconnecting said first inlet distal end to said first outlet distal end, said first linkage assembly including a first pin pivotably interconnecting said first connector to said first crank, said second linkage assembly interconnecting said second inlet distal end to said second outlet distal end to operate said inlet right poppet disc in tandem with said outlet right poppet disc, said second linkage assembly including a second connector pivotably interconnecting said second inlet distal end to said second outlet distal end, said second linkage assembly including a second pin pivotably interconnecting said second connector to said second crank, said left discharge port of said inlet valve assembly being in fluid communication with said first inlet port of said first heat exchanger, said right discharge port of said inlet valve assembly being in fluid communication with said second inlet port of said second heat exchanger, said left receiving port of said outlet valve assembly being in fluid communication with said first outlet port of said first heat exchanger, said right receiving port of said outlet valve assembly being in fluid communication with said second outlet port of said second heat exchanger, said drive shaft defining a first rotational position and a second rotational position spaced radially about said drive shaft by 180 degrees, said inlet left poppet disc sealing against said lower left inlet valve seat when said drive shaft is moved to said first rotational position to define a first flow path for moving dirty hot gas from said dirty gas inlet and through said upper left inlet valve port and through said left discharge port and into said first heat exchanger for transferring heat from the dirty hot gas to said first heat recovery media to produce dirty cold gas, said outlet left poppet disc sealing against said lower left outlet valve seat when said drive shaft is moved to said first rotational position to further define the first flow path for moving the dirty cold gas from said first heat exchanger and through said left receiving port and through said upper left outlet valve port and out through said dirty gas outlet, said inlet right poppet disc sealing against said upper right inlet valve seat when said drive shaft is moved to said first rotational position to define a second flow path for moving clean cold gas from said clean gas inlet and through said lower right inlet valve port and through said right discharge port and into said second heat exchanger for transferring heat from said second heat recovery media to the clean cold gas to produce clean hot gas, said outlet right poppet disc sealing against said upper right outlet valve seat when said drive shaft is moved to said first rotational position to further define the second flow path for moving the clean hot gas from said second heat exchanger and through said right receiving port and through said lower right outlet valve port and out through said clean gas outlet, said inlet left poppet disc sealing against said upper left inlet valve seat when said drive shaft is moved to said second rotational position to define a third flow path for moving clean cold gas from said clean gas inlet through said lower left inlet valve port and through said left discharge port and into said first heat exchanger for transferring heat from said first heat recovery media to said clean cold gas to produce clean hot gas, said outlet left poppet disc sealing against said upper left outlet valve seat when said drive shaft is moved to said second rotational position to further define the third flow path for moving the clean hot gas from said first heat exchanger and through said right receiving port and through said lower left outlet valve port and out through said clean gas outlet, said inlet right poppet disc sealing against said lower right inlet valve seat when said drive shaft is moved to said second rotational position to define a fourth flow path for moving dirty hot gas from said dirty gas inlet and through said upper right inlet valve port and through said right discharge port and into said second heat exchanger for transferring heat from the dirty hot gas to said second heat recovery media to produce dirty cold gas, and said outlet right poppet disc sealing against said lower right outlet valve seat when said drive shaft is moved to said second rotational position to further define the fourth flow path for moving the dirty cold gas from said second heat exchanger and through said right receiving port and through said upper right outlet valve port and out through said dirty gas outlet.

18. A method of transferring heat from a dirty hot gas stream to a clean cold gas stream to produce a dirty cold gas stream and a clean hot gas stream, said method comprising;

moving a pair of inlet poppet discs within an inlet valve assembly to a first position, receiving a dirty hot gas in the inlet valve assembly, receiving a clean cold gas in the inlet valve assembly, flowing the dirty hot gas through a left inlet valve area and into a first heat exchanger, flowing the clean cold gas through a right inlet valve area and into a second heat exchanger, transferring heat from the dirty hot gas to a plurality of first heat recovery media within the first heat exchanger to produce dirty cold gas, transferring heat from a plurality of second heat recovery media within the second heat exchanger to the clean cold gas to produce clean hot gas, moving a pair of outlet poppet discs within an outlet valve assembly to the first position, receiving the dirty cold gas in the outlet valve assembly, receiving the clean hot gas in the outlet valve assembly, flowing the dirty cold gas through a left outlet valve area to discharge the dirty cold gas through a dirty gas outlet, flowing the clean hot gas through a right outlet valve area to discharge the clean hot gas through a clean gas outlet, moving the inlet poppet discs to a second position, flowing the clean cold gas through the left inlet valve area and into the first heat exchanger, flowing the dirty hot gas through the right inlet valve area and into the second heat exchanger, transferring heat from the first heat recovery media within the first heat exchanger to the clean cold gas to produce clean hot gas, transferring heat from the dirty hot gas to the second heat recovery media within the second heat exchanger to produce dirty cold gas, moving the outlet left poppet disc and the outlet right poppet disc to the second position, flowing the clean hot gas through the right outlet valve area to discharge the clean hot gas through the clean gas outlet, flowing the dirty cold gas through the left outlet valve area to discharge the dirty cold gas through the dirty gas outlet, and said steps of moving the inlet poppet discs and said steps of moving the outlet poppet discs being further defined as orbiting a first linkage assembly interconnecting one of the inlet poppet discs and one of the outlet poppet discs about an axis to perform said moving steps in tandem.

19. A method as set forth in claim 18 wherein said steps of moving the inlet poppet discs and said steps of moving the outlet poppet discs is further defined as orbiting a second linkage assembly interconnecting the other one of the inlet poppet discs with the other one of the outlet poppet discs about the axis 180 degrees out of phase with the first linkage assembly.

20. A method as set forth in claim 19 wherein said steps of moving the inlet and outlet poppet discs are further defined as accelerating the first and second linkage assemblies for 0.2 seconds and decelerating the first and second linkage assemblies for 0.3 seconds to move the inlet and outlet poppet discs between the first and second positions every 0.5 seconds.

* * * * *